United States Patent [19]

Mickey, III

[11] Patent Number: 4,965,538

[45] Date of Patent: Oct. 23, 1990

[54] MICROWAVE ATTENUATOR

[75] Inventor: Joseph J. Mickey, III, West Palm Beach, Fla.

[73] Assignee: Solitron Devices, Inc., Riviera Beach, Fla.

[21] Appl. No.: 313,640

[22] Filed: Feb. 22, 1989

[51] Int. Cl.[5] ..... H01P 1/22

[52] U.S. Cl. ..... 333/81 A; 338/314; 338/322; 338/324; 338/327

[58] Field of Search ..... 333/81 R, 81 A; 338/314, 322, 324, 327

[56] References Cited

U.S. PATENT DOCUMENTS

| | | | |
|---|---|---|---|
| 3,157,846 | 11/1964 | Weinschel . | |
| 3,227,975 | 1/1966 | Hewlett et al. . | |
| 3,474,305 | 10/1969 | Szupillo . | |
| 3,534,302 | 10/1970 | Lee . | |
| 3,582,842 | 6/1971 | Friedman . | |
| 3,599,125 | 8/1971 | Yoshida . | |
| 3,676,807 | 7/1972 | Boer . | |
| 4,272,739 | 6/1981 | Nesses . | |
| 4,309,677 | 1/1982 | Goldman . | |
| 4,456,894 | 6/1984 | Lapart | 333/81 A X |
| 4,570,133 | 2/1986 | Bacher . | |
| 4,670,723 | 6/1987 | Roland et al. . | |
| 4,672,336 | 6/1987 | Thomas . | |

*Primary Examiner*—Paul Gensler
*Attorney, Agent, or Firm*—Staas & Halsey

[57] ABSTRACT

A microwave attenuator is constructed on an insulative substrate which supports a resistive region, input/output electrodes and shunt electrodes. The shunt electrodes are preferably constructed using trapezoidally shaped portions on the face of the insulative substrate, on which the resistive region is formed, to increase the width of the electrodes. The shunt electrodes extend down to a ground plane on the face of the insulative substrate opposite the face on which the resistive region is formed. In one embodiment, the shunt electrodes form a wide strip on the outside of a rectangular substrate. In another embodiment, the shunt electrodes extend from the resistive region through holes positioned close to the resistive region. In a third embodiment, the insulative substrate is formed in a block H-shape with the resistive region formed on the cross portion on one of the "H" faces and the shunt electrodes connects the resistive region to the ground plane which is formed on the opposing "H" face, by passing between the long parallel portions of the block H-shape.

5 Claims, 3 Drawing Sheets

FIG. 4
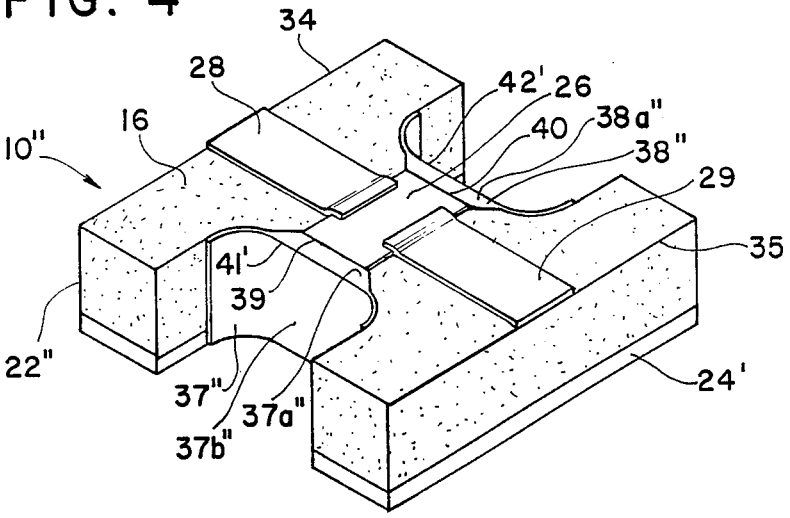
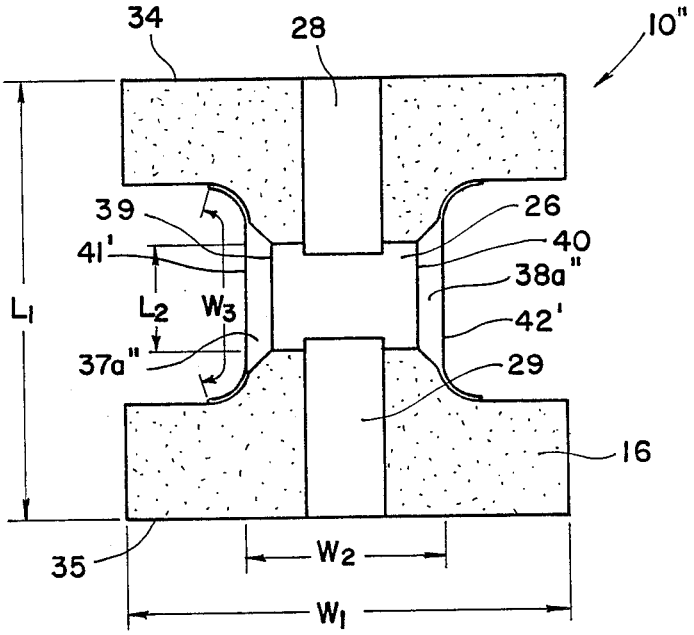
FIG. 5

MICROWAVE ATTENUATOR

BACKGROUND OF THE INVENTION

1. Field of the Invention

The present invention is related to a microwave attenuator and, more particularly, to a thin-film microwave attenuator capable of attenuating high frequency signals by over 10 dB.

2. Description of the Related Art

Thin-film microwave attenuators have been known in the art at least since the issuance of U.S. Pat. No. 3,227,975 to Hewlett et al. in 1966. As is known in the art, this early design included a thin film of resistive material mounted on insulative material, suspended in a metallic cylinder which was coupled to the outer conductor of a coaxial cable. The resistant material was shaped in a rectangle having a major axis aligned with the axis of the cylinder. Grounding electrodes made contact between opposing sides of the resistive material and the cylinder, while input/output electrodes made contact with the inner conductor of coaxial cables and the sides of the resistive material which were perpendicular to the cylinder.

Numerous modifications have been made to this basic design including having multiple resistive regions mounted on the same insulative substrate; coating the entire surface of the insulative substance, opposite the side on which the resistant material is placed, with a conductive layer to form a ground plane; and shaping the electrodes to simplify connection to a coaxial cable. Examples of some of these modifications can be found in U.S. Pat. No. 3,582,842 to Friedman and U.S. Pat. No. 4,309,677 to Goldman. The attenuator taught by Friedman uses four separate resistive regions, shaped as annular sectors, connected together by a conductive disc and having separate electrodes connected to the outer arcs of each sector. Such a device is not particularly well suited to high frequency applications. The attenuator taught by Goldman uses three resistive regions including, two rectangular ones, each having an input/output electrode connected thereto. Between these two rectangular resistive regions is a conductive region, rectangular in outline, surrounding an annular resistive region. The center of the third, annular resistive region surrounds a hole through the insulative substrate. The hole is coated with conductive material to connect the center of the annular region to a ground plane formed by a conductive surface on the bottom of the insulative substrate. The electrically conductive throughhole is described as minimizing undesired parasitic impedances according to empirical data. The design taught by Goldman also is poorly suited to high frequency operation due to excessive reflections caused by the large number of interfaces between the two rectangular resistive regions.

These and numerous other designs which have been proposed and used for thin-film microwave attenuators are incapable of providing 20 dB attenuation of frequencies at 18 GHz or higher.

SUMMARY OF THE INVENTION

An object of the present invention is to provide a microwave attenuator capable of over 10 dB attenuation of frequencies over 10 GHz.

Another object of the present invention is to provide a high-frequency microwave attenuator providing attenuation of over 10 dB with a relatively low reflection coefficient.

The above objects are obtained by providing a microwave attenuator, comprising an insulative substrate; a ground plane formed by a conductive layer coating a substantial portion of a first face of the insulative substrate; a resistive region formed on a second face of the insulative substrate opposite the first face thereof; input/output electrodes connected to a first set of opposing edges of the resistive region and respectively extending towards first and second edges of the insulative substrates; and shunt electrodes connected to the ground plane and a second set of opposing edges of the resistive region, different from the first set of opposing edges. Preferably, the shunt electrodes each have a trapezoidal shape on the second face of the insulative substrate, with a short side in contact with the resistive region and a long side at one of third and fourth edges of the insulative substrate, respectively. In the preferred embodiment, there is a single resistive region and the shunt electrodes extend between the first and second faces of the insulative substrate through a hole or side cut in the insulative substrate.

These objects, together with other objects and advantages which will be subsequently apparent, reside in the details of construction and operation as more fully hereinafter described and claimed, reference being had to the accompanying drawings forming a part hereof, wherein like reference numerals refer to like parts throughout.

BRIEF DESCRIPTION OF THE DRAWINGS

FIG. 4 is a perspective view of a third embodiment of the present invention; and FIG. 5 is a plan view of the third embodiment of the present invention.

DESCRIPTION OF THE PREFERRED EMBODIMENTS

Figure 1:
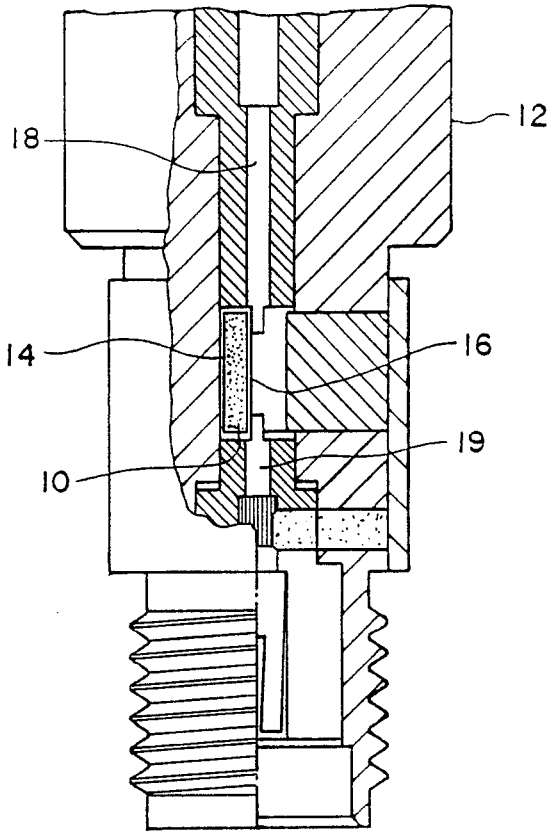
FIG. 1 is a partial cross-section of a coaxial connector including a microwave attenuator according to the present invention.

A conventional orientation of a microwave attenuator 10 in a coaxial connector 12 is illustrated in FIG. 1. The microwave attenuator 10 is preferably constructed according to the present invention. As illustrated in FIG. 1, a first face 14 of the microwave attenuator 10 is placed in contact with the outer shell of the connector 12 which is in electrical connection with the outer conductor of the coaxial cable (not shown) connected thereto. The opposite face 16 of the microwave attenuator 10 is placed in contact with pins 18, 19 which are or can be in electrical connection with the inner conductor of coaxial cables.

Figure 2:
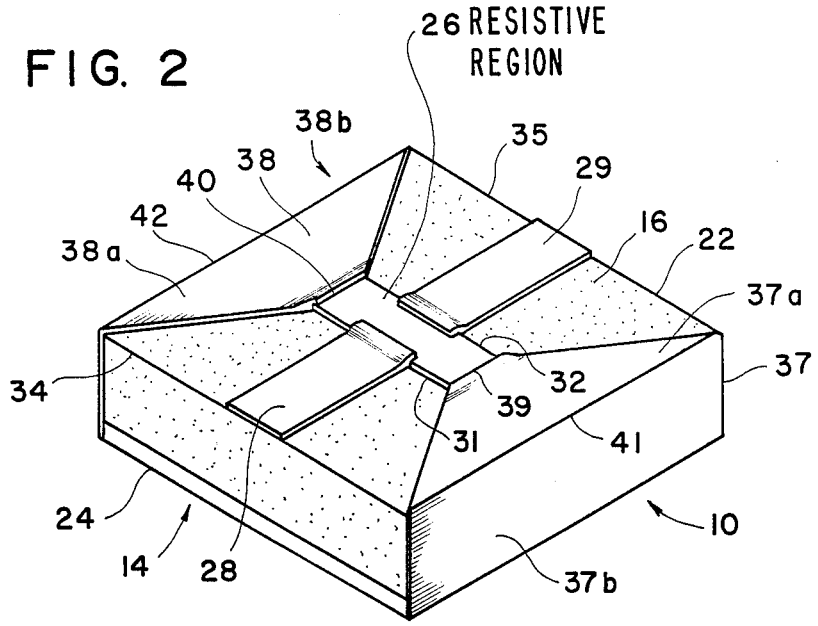
FIG. 2 is a perspective view of a first embodiment of the present invention.

A first embodiment of the present invention is illustrated in FIG. 2. As illustrated therein, a microwave attenuator 10 according to the present invention includes an insulative substrate 22 which may be formed of, e.g., aluminum oxide, beryllium oxide, sapphire, etc. On the first face 14 of the insulative substrate 22, a conductive layer of, e.g., gold or copper, forms a ground plane 24. On the opposing, second, face 16 of the insulative substrate 22, a resistive region 26 is formed by a layer of, e.g., tantalum nitride or nichrome.

The resistive region is in contact with input/output electrodes 28, 29 connected to the resistive region 26 at a first set of opposing sides 31, 32 and respectively extending towards first and second edges 34, 35 of the insulative substrate 22. These input/output electrodes 28, 29 may be formed of material similar to that of the ground plane 14 in a conventional manner.

In addition to the input/output electrodes 28, 29, shunt electrodes 37, 38 are formed of similar conductive material on the insulative substrate 22. The shunt electrodes 37, 38 are connected between the ground plane 24 and a second set of opposing sides 39, 40, respectively. As illustrated in FIG. 2, the shunt electrodes 37, 38 include portions **37*a*, 38*a* on the second face 16 of the insulative substrate 22 and portions 37*b*, 38*b* on opposing faces of the insulative substrate 22 perpendicular to the first and second faces 14, 16. The portion 38*b* of the shunt electrode 28 cannot be seen in the perspective view of FIG. 2, but is shaped similar to that of portion 37*b*'. The portions 37*a* and 38*a* preferably have a trapezoidal shape. As illustrated, the short side of the trapezoid is in contact with the resistive region 26 and the long side of the trapezoid is located at one of third and fourth edges 41, 42 of the insulative substrate 22**.

The trapezoidal shape of the portion **37*a*, 38*a* of the shunt electrodes 37, 38 help reduce the inductance of the shunt electrode 37, 38 by increasing the width of the connection between the second set of edges 39, 40 of the resistive region 26 and the ground plane 24. Changes in the ratio between the length and width of the shunt electrodes 37, 38** affect the inductance thereof.

Low inductance shunt electrodes are desirable when a microwave attenuator is used to attenuate high frequency (over 10 GHz) microwaves. This is because the inductive reactance of the shunt electrodes is defined by formula (1), where $Z_0$ is the characteristic impedance of the line, l is the line length and $\lambda_\epsilon$, is the wavelength of the signal in a circuit with an effective dielectric constant.

It will be apparent that as l approaches $\lambda_{68}/4$, tan $2\pi l/E$ (1) approaches infinity. As a result, the shunt to ground provided by the shunt electrodes 37, 38 becomes increasingly less effective until it becomes essentially an open circuit instead of the desired short circuit. The first embodiment illustrated in FIG. 2 reduces the inductive reactance by reducing the characteristic impedance $Z_0$. By using shunt electrodes constructed as illustrated in FIG. 2, the characteristic impedance $Z_0$ is approximately one-half of the (characteristic) impedance which would result from using electrodes no wider than the length of the second set of sides 39, 40 of the resistive region 26.

Figure 3:
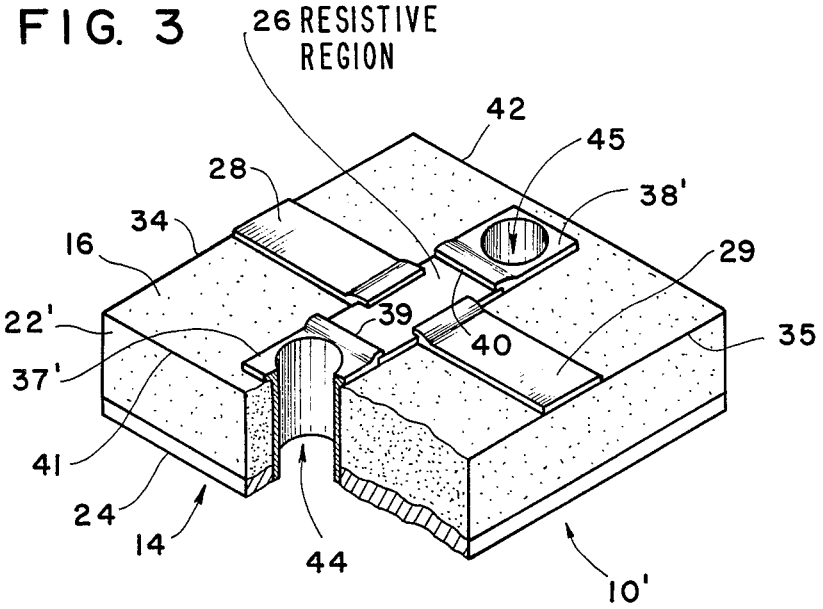
FIG. 3 is a perspective and partial cross-section view of a second embodiment of the present invention.

An alternative way of reducing the inductive reactance is to reduce the length l of the shunt electrodes 37, 38; thereby, slowing the rate at which tan $2\pi l/\lambda_{68}$ approaches infinity. According to the second embodiment of the present invention, the length l is reduced by forming holes 44, 45 in the insulative substrate 22', as illustrated in FIG. 3. The holes 44, 45 extend between the first and second faces 14, 16 of the insulative substrate 22' and are located between the second set of opposing sides 39, 40 of the resistive region 26 and the third and fourth edges 41, 42 of the insulative substrate, respectively. The shunt electrodes 37', 38' of the microwave attenuator 10' in the second embodiment are extended down the holes 44, 45 to reduce as much as possible the distance between the sides 39, 40 of the resistive region 26 and the ground plane 24. Thus, the inductive reactance of the shunt electrodes 37', 38' is reduced.

A third embodiment of the present invention, illustrated in FIGS. 4 and 5, combines features of both the first and second embodiments. In the third embodiment, the insulative substrate 22'' is formed in a block H-shape where the first and second edges 34, 35 of the insulative substrate 22'' are on long portions of the block H-shape and the third and fourth edges 41', 42' of the insulative substrate 22'' form opposite edges of a cross portion connecting the long portions of the block H-shape and supporting the resistive region 26.

The distance between the edges 34 and 35 may be considered the length $L_1$ (see FIG. 5) of the attenuator 10'', since this is in the direction of microwave propagation between the input and output electrodes 28, 29. A first width $W_1$ may be measured along either of the edges 34, 35. A second width $W_2$, measured between the edges 41'42', e.g., along a line approximately midway between the edges 34 and 35 is significantly smaller than the first width $W_1$. As a result, the portions **37*a*'', 38*a*'' of the shunt electrodes 37'', 38'', each have an area, bounded by a trapezoid, which is considerably smaller than the area of the corresponding portions 37*a*, 38*a* in the first embodiment, illustrated in FIG. 2. In addition, the portion 37*b*'' of the shunt electrode 37'' and the corresponding portion of shunt electrode 38'' are each formed to have a width $W_3$ which may be as much as twice the length $L_2$ of the second set of opposing sides 39, 40**. As a result, both the length l and the characteristic line impedance $Z_0$ are reduced.

The third embodiment has an advantage over the second embodiment in that the portion **37*b*'' of the shunt electrode 37'' and the corresponding portion of shunt electrode 38'' can be formed more easily due to the larger opening on the side of the substrate 22'' in the third embodiment, as illustrated in FIGS. 4 and 5, compared to the holes 44, 45 in the second embodiment as illustrated in FIG. 3. The use of the block H-shaped substrate 22'' in the third embodiment, instead of a narrower version of the first embodiment, simplifies the mounting of the attenuator 10'' in the location illustrated in FIG. 1 for the attenuator 10. In addition, the use of the block H-shaped substrate 22''** aids in heat dissipation.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope and spirit of the invention as recited in the appended claims.

What is claimed is:

1. A microwave attenuator, comprising:

an insulative substrate having first, second, third and fourth edges;

a ground plane formed by a conductive layer coating a substantial portion of a first face of said insulative substrate;

a resistive region formed on a second face of said insulative substrate, opposite the first face thereof;

input/output electrodes connected to a first set of opposing sides of said resistive region and respectively extending towards the first and second edges of said insulative substrate;

shunt electrodes connected to said ground plane and a second set of opposing sides of said resistive region, different from the first set of opposing sides, said shunt electrodes each having a trapezoidal shape on the second face of said insulative substrate, with a short side in contact with said resistive region and a long side at one of the third and fourth edges of said insulative substrate, respectively.

2. A microwave attenuator as recited in claim 1, wherein said resistive region is formed by a single continuous layer.

3. A microwave attenuator as recited in claim 2, wherein the first and second faces of said insulative substrate are formed in a block H-shape where the first and second edges of said insulative substrate are on long portions of the block H-shape and the third and fourth edges of said insulative substrate are opposite edges of a cross portion connecting the long portions of the block H-shape.

4. A microwave attenuator as recited in claim 1, wherein said insulative substrate has a length measured between the first and second edges, a first width measured along either of the first and second edges, and a second width, significantly smaller than the first width, measured between the third and fourth edges of said insulative substrate along a line and approximately midway between the first and second edges thereof.

5. A microwave attenuator, comprising:

an insulative substrate having first, second, third and fourth holes and a pair of holes extending between first and second faces opposite each other;

a ground plane formed by a conductive layer coating a substantial portion of the first face of said insulative substrate;

a resistive region formed on the second face of said insulative substrate;

input/output electrodes connected to a first set of opposing sides of said resistive region and respectively extending towards the first and second edges of said insulative substrate; and shunt electrodes connected to said ground plane and a second set of opposing sides of said resistive region, different from the first set of opposing sides, the holes in said insulative substrate located between the second set of opposing sides of said resistive region and the third and fourth edges of said insulative substrate, respectively, said shunt electrodes extending through the holes in said insulative substrate.

* * * * *